US011774882B1

(12) United States Patent
Kureyama et al.

(10) Patent No.: US 11,774,882 B1
(45) Date of Patent: Oct. 3, 2023

(54) CONNECTION STRUCTURE AND IMAGE FORMING APPARATUS

(71) Applicant: FUJIFILM Business Innovation Corp., Tokyo (JP)

(72) Inventors: Tadashi Kureyama, Kanagawa (JP); Takashi Anzai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/900,890

(22) Filed: Sep. 1, 2022

(30) Foreign Application Priority Data

Mar. 24, 2022 (JP) ..... 2022-049095

(51) Int. Cl.
*G03G 15/08* (2006.01)

(52) U.S. Cl.
CPC ..... *G03G 15/0877* (2013.01); *G03G 15/0894* (2013.01)

(58) Field of Classification Search
CPC ..... G03G 15/0877; G03G 15/0894; G03G 15/0865; G03G 2221/1648; G03G 2215/0692; G03G 15/0886
See application file for complete search history.

(56) References Cited

U.S. PATENT DOCUMENTS 5,614,996 A * 3/1997 Tanda ..... G03G 15/0865 141/363
2017/0153576 A1* 6/2017 Fujimura ..... G03G 15/0877

FOREIGN PATENT DOCUMENTS

JP H09197789 7/1997
JP 2010055035 3/2010

* cited by examiner

*Primary Examiner* — Sandra Brase
(74) *Attorney, Agent, or Firm* — JCIPRNET

(57) ABSTRACT

A connection structure includes a receiving port for a developer, that is provided in a developing machine, a supply port for a developer, that is provided in a replenisher, a connecting portion that is provided in a vicinity of the supply port of the replenisher and connects the developing machine and the replenisher to each other in a state where a developer is suppliable from the supply port to the receiving port in a case where a portion in a vicinity of the receiving port of the developing machine is inserted, a leading surface that is provided at the connecting portion and leads the portion in the vicinity of the receiving port of the developing machine to the connecting portion, an opening and closing member that opens and closes the receiving port by moving in an insertion direction of the developing machine, and a contact member that is provided at the opening and closing member and comes into contact with the leading surface in an elastically deformed state in a case where the developing machine and the replenisher are connected to each other.

20 Claims, 10 Drawing Sheets

CONNECTION STRUCTURE AND IMAGE FORMING APPARATUS

CROSS-REFERENCE TO RELATED APPLICATIONS

This application is based on and claims priority under 35 USC 119 from Japanese Patent Application No. 2022-049095 filed Mar. 24, 2022.

BACKGROUND

(i) Technical Field

The present disclosure relates to a connection structure and an image forming apparatus.

(ii) Related Art

JP1997-197789A discloses a developer replenishing container having a container body that has an opening portion, a shutter that is for closing the opening portion of the container body, shutter supporting means for supporting the shutter to obtain a closing position where the opening portion is closed and an open position where the opening portion is open by retracting from the closing position, a recessed shutter guide portion that is formed in the shutter supporting means, and a seal member that is attached to a surface of the shutter on an opening portion side over the opening portion and the shutter guide portion, in which in a space formed between both side surfaces, which are substantially parallel to a moving direction of the shutter, and the shutter guide portion, an elastic portion for sealing a part of the space is provided.

JP2010-55035A discloses a toner receiving apparatus that receives a toner replenished from a toner replenishing apparatus having a toner discharging member in which a toner discharge port is formed in a lower surface and a first shutter member which can open and close the toner discharge port, the toner receiving apparatus including a toner receiving member, in which a toner receiving port for receiving the toner discharged from the toner discharge port is formed and the toner receiving port is positioned below the toner discharge port in a case of being connected to the toner discharging member, a second shutter member that can open and close the toner receiving port, and a shutter opening and closing mechanism that brings the second shutter member from a closed state to an open state and then brings the first shutter member from the closed state to the open state, in a case of being connected to the toner replenishing apparatus.

SUMMARY

Providing a leading surface for leading a developing machine to a connecting portion for connecting the developing machine to a replenisher is conceivable. However, in a case where the leading surface is provided, a gap between the leading surface and a surface of the developing machine in the vicinity of a receiving port may be wide, and a developer may leak from the gap.

Aspects of non-limiting embodiments of the present disclosure relate to a connection structure and an image forming apparatus that suppress leakage of a developer from a connecting portion between a developing machine and a replenisher compared to a configuration where the developing machine and the replenisher are connected to each other so that an opening and closing member of the developing machine is brought into contact with a leading surface provided at the connecting portion of the replenisher.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a connection structure including a receiving port for a developer, that is provided in a developing machine, a supply port for a developer, that is provided in a replenisher, a connecting portion that is provided in a vicinity of the supply port of the replenisher and connects the developing machine and the replenisher to each other in a state where a developer is suppliable from the supply port to the receiving port in a case where a portion in a vicinity of the receiving port of the developing machine is inserted, a leading surface that is provided at the connecting portion and leads the portion in the vicinity of the receiving port of the developing machine to the connecting portion, an opening and closing member that opens and closes the receiving port by moving in an insertion direction of the developing machine, and a contact member that is provided at the opening and closing member and comes into contact with the leading surface in an elastically deformed state in a case where the developing machine and the replenisher are connected to each other.

BRIEF DESCRIPTION OF THE DRAWINGS

Exemplary embodiment(s) of the present invention will be described in detail based on the following figures, wherein.

DETAILED DESCRIPTION

Hereinafter, one exemplary embodiment of the present disclosure will be described with reference to the drawings. For convenience of description, an arrow UP shown in each drawing will be referred to as an upward direction of an apparatus, an arrow LH will be referred to as a left direction (a left direction in a case of being viewed from the front) of the apparatus, and an arrow FR (a front side of the page in FIG. 1) will be referred to as a front direction of the apparatus. In addition, the upward direction of the apparatus will be referred to as "upward of the apparatus" or "upward" as appropriate, the left direction of the apparatus will be referred to as "leftward of the apparatus" or "leftward" as appropriate, and the front direction of the apparatus will be referred to as "front of the apparatus" or "front" as appropriate. An apparatus right-left direction may also be called an apparatus width direction (also simply referred to as a "width direction"), and an apparatus front-rear direction (also simply referred to as a "front-rear direction") may also be called an apparatus depth direction (also simply referred to as a "depth direction").

Image Forming Apparatus

An image forming apparatus 10 of the present exemplary embodiment will be described with reference to FIG. 1.

Figure 1:
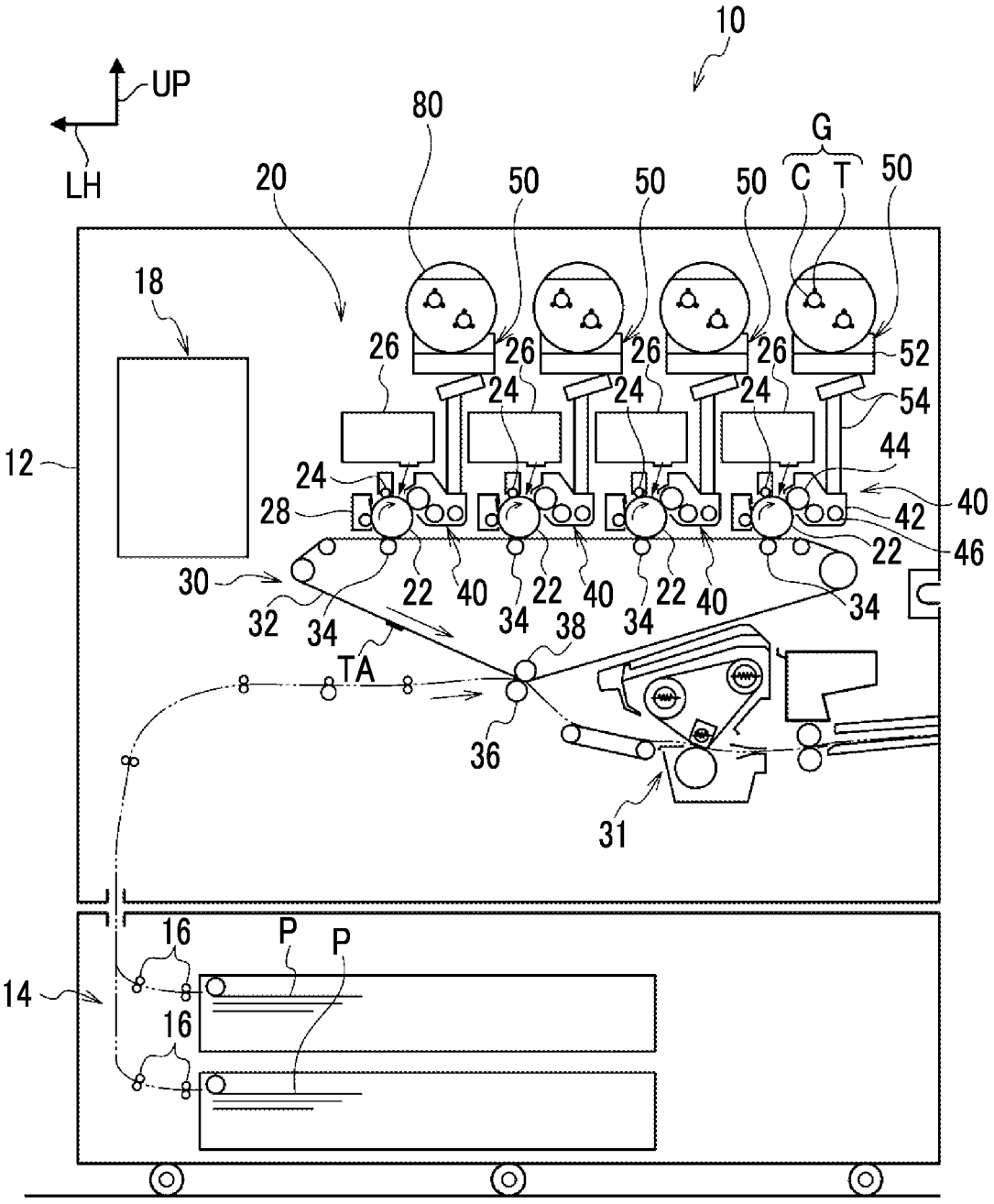
FIG. 1 is an overall configuration view schematically showing an image forming apparatus according to one exemplary embodiment of the present disclosure.

As shown in FIG. 1, the image forming apparatus 10 has, in an apparatus body 12, a transport unit 14 that includes a pair of rollers 16 transporting a recording medium P such as paper, an image forming portion 20 that forms a toner image TA on the recording medium P transported by the transport unit 14, using a developer G, and a control unit 18 that controls an operation of each unit of the image forming apparatus 10.

The developer G has, as major components, a toner T that is an example of powder charged to a negative polarity and a carrier C made of iron that is an example of a magnetic body charged to a positive polarity and is configured to contain an additive. The toner T is made of, for example, a polyester resin. In addition, the toner image TA is an example of a developer image.

The image forming portion 20 has four photoreceptors 22, four charging rollers 24, four exposure devices 26, and four developing devices 40 corresponding to colors including yellow (Y), magenta (M), cyan (C), black (K), respectively. The image forming portion 20 has one transfer unit 30 and one fixing unit 31. The photoreceptor 22 is an example of an image holding body that can hold an image. The developing device 40 is an example of a developing machine that forms a developer image (toner image TA) on the image holding body (photoreceptor 22).

The photoreceptor 22 is configured by a cylindrical conductive substrate and is rotationally driven in an arrow direction shown with the apparatus front-rear direction as an axial direction. A charge generation layer and a charge transporting layer (both are not shown) are formed at an outer peripheral surface of the conductive substrate configuring the photoreceptor 22. Therefore, an outer peripheral surface of the photoreceptor 22 is brought into a charged state due to discharge caused by a potential difference from the charging roller 24, and an electrostatic latent image is formed (held) on the outer peripheral surface by being irradiated (exposed) with light from the exposure device 26 in this charged state.

The developing device 40 develops the electrostatic latent image formed on the outer peripheral surface of the photoreceptor 22 using the developer G. To describe specifically, the developing device 40 has a housing 42 that is an example of a developing device body storing the developer G replenished from a replenishing device 50, which is an example of a replenisher, a developing roller 44 that is rotatably provided in the housing 42 with the apparatus front-rear direction as an axial direction, and an auger 46 that is rotatably provided in the housing 42 with the apparatus front-rear direction as an axial direction.

The developing roller 44 is formed in a cylindrical shape and is provided with a plurality of magnetic poles (not shown) arranged on an inner peripheral surface side in a circumferential direction. The developing roller 44 holds the developer G replenished from the replenishing device 50 with an outer peripheral surface by means of a magnetic force of the magnetic poles.

The auger 46 is rotatably supported in the housing 42 by a front cover (not shown) and a rear cover 48 of the housing 42. The auger 46 moves the developer G in the housing 42 forward while agitating the developer, by means of a rotational force from a rotational drive unit (not shown). The auger 46 is an example of a transport member that transports a developer.

In the present exemplary embodiment, the photoreceptor 22 and the developing device 40 are integrated with each other. Specifically, the photoreceptor 22 and the developing device 40 are connected to each other by a bracket (not shown). For this reason, the photoreceptor 22 and the developing device 40 are integrally mounted or removed with respect to the apparatus body 12. The present disclosure is not limited thereto, and the photoreceptor 22 and the developing device 40 may be separate bodies. Herein, a mounting direction of the developing device 40, that is, an insertion direction into the apparatus body 12 is rearward in the apparatus front-rear direction. On the other hand, a removing direction of the developing device 40, that is, an opposite direction to the insertion direction into the apparatus body 12 is forward in the apparatus front-rear direction.

Figure 2:
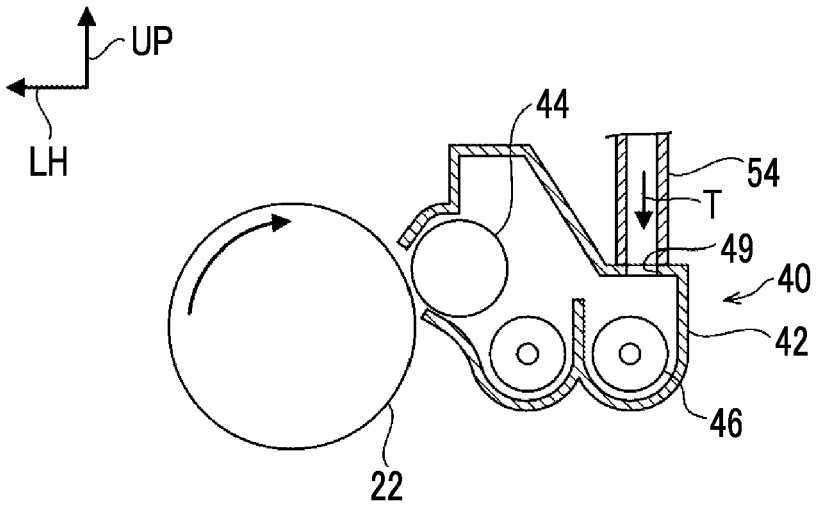
FIG. 2 is a configuration view schematically showing an image holding body, a developing machine, and a vicinity of a replenishing path of a replenisher of FIG. 1.

As shown in FIG. 2, the replenishing device 50 replenishes the developing device 40 with the developer G. Specifically, the replenishing device 50 is connected to a toner cartridge 80 and replenishes the developing device 40 with the developer G accommodated in the toner cartridge 80. The replenishing device 50 has a body portion 52 that is connected to the toner cartridge 80 and receives the developer G in the toner cartridge 80 and a replenishing path 54 for replenishing the developing device 40 with the developer G from the body portion 52. The transport member (not shown) such as an auger for transporting the developer G toward the developing device 40 is provided inside each of the body portion 52 and the replenishing path 54. In addition, the replenishing device 50 is fixed to the apparatus body 12.

The transfer unit 30 includes an intermediate transfer belt 32, a primary transfer roller 34, a secondary transfer roller 36, and a facing roller 38 that faces the secondary transfer roller 36 with the intermediate transfer belt 32 sandwiched therebetween.

The transfer unit 30 primarily transfers the toner image TA developed by the developing device 40 onto the intermediate transfer belt 32 by means of a potential difference between the photoreceptor 22 and the primary transfer roller 34. Then, the transfer unit 30 secondarily transfers the toner image TA on the intermediate transfer belt 32 to the recording medium P transported by the transport unit 14 by means of a potential difference between the secondary transfer roller 36 and the facing roller 38.

The fixing unit 31 heats and pressurizes the toner image TA transferred to the recording medium P and fixes the toner image to the recording medium P. The recording medium P to which the toner image TA is fixed by the fixing unit 31 is discharged to, for example, a discharge portion (not shown) provided outside the apparatus body 12. The developer G remaining on the outer peripheral surface of the photoreceptor 22 without being transferred onto the intermediate transfer belt 32 is removed from the outer peripheral surface by a cleaning device 28.

Connection Structure

Next, a connection structure S of the present exemplary embodiment will be described.

Figure 3:
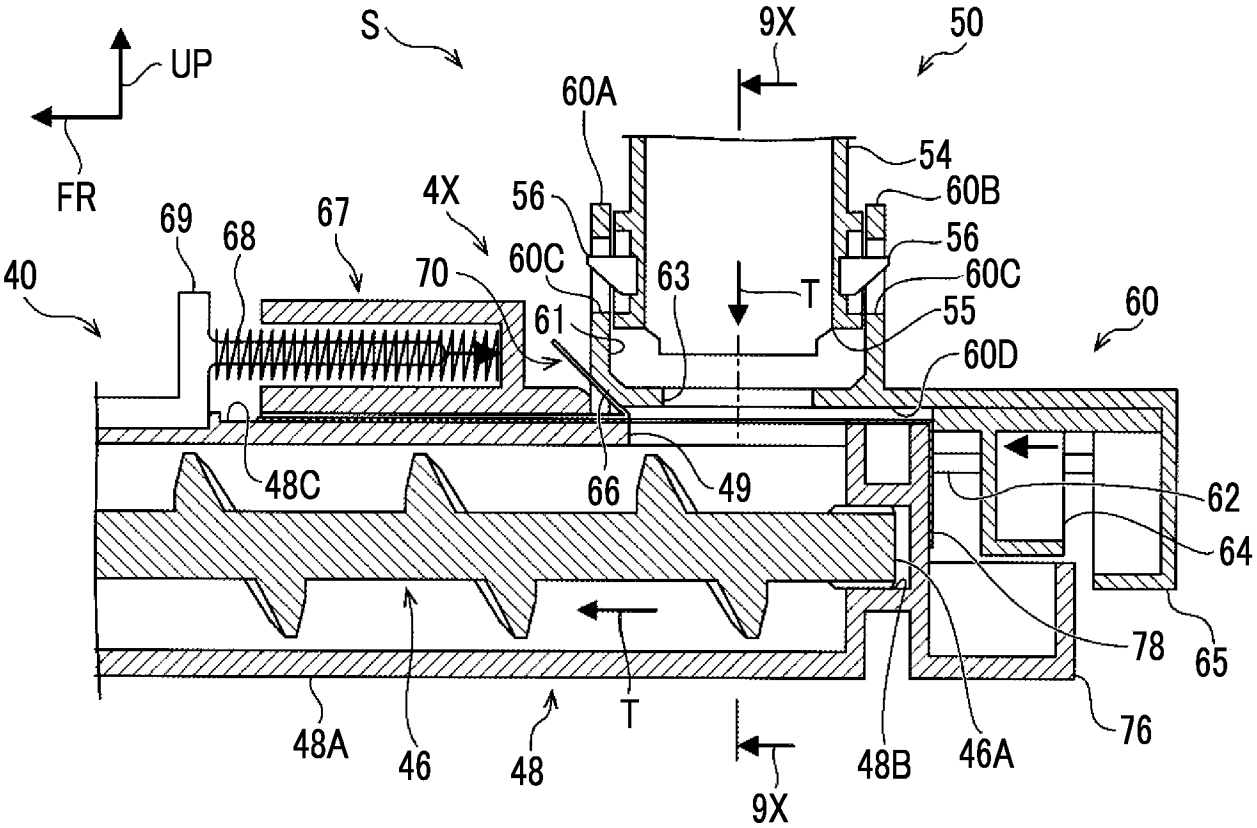
FIG. 3 is a cross-sectional view of the developing machine of FIG. 2 and a connecting portion of the replenisher taken along an apparatus front-rear direction and shows a state where the developing machine is connected to the replenisher.

As shown in FIG. 3, the connection structure S has a receiving port 49, a supply port 55, a holder 60, a leading surface 66, a receiving port shutter 67, and a seal member 70. The holder 60 is an example of a connecting portion in the present disclosure, the receiving port shutter 67 is an example of an opening and closing member in the present disclosure, and the seal member 70 is an example of a contact member in the present disclosure.

Receiving Port

Figure 4:
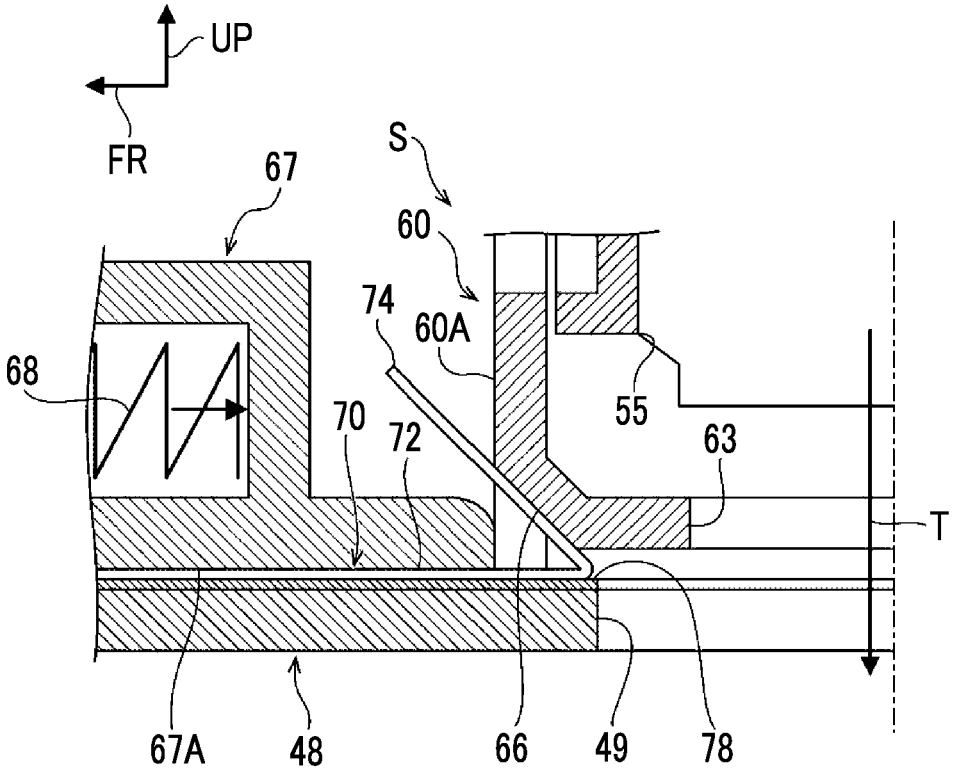
FIG. 4 is an enlarged view of a portion indicated by an arrow 4X in FIG. 3.
Figure 9:
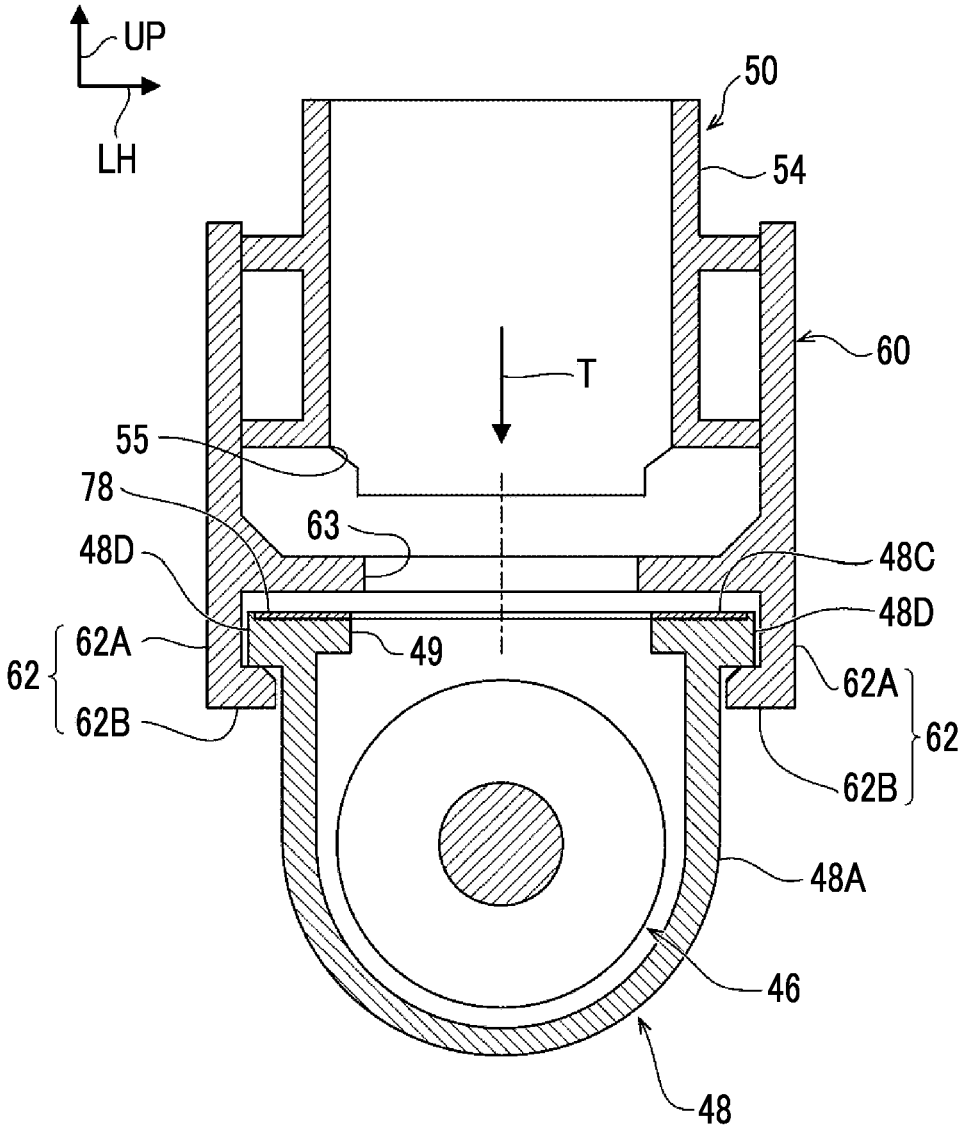
FIG. 9 is a cross-sectional view taken along line 9X-9X of FIG. 3.

As shown in FIGS. 3 and 4, the receiving port 49 is an opening portion provided on a rear side of the developing device 40 and is a portion that receives the replenishment of the developer G from the replenishing device 50. Specifically, the receiving port 49 is provided in the rear cover 48 of the housing 42. The rear cover 48 configures a rear end portion of the housing 42, in which the developer G is stored, and includes a tubular portion 48A and a support portion 48B. A rear end portion 46A of the auger 46 is arranged inside the tubular portion 48A. The support portion 48B is provided with a closing portion that closes an end portion of the tubular portion 48A and rotatably supports the rear end portion 46A of the auger 46. In addition, as shown in FIGS. 3 and 9, the rear cover 48 is provided with a flat portion 48C at an upper portion. Both ends of the flat portion 48C project outward from an outer peripheral surface of the tubular portion 48A. A pair of projecting portions 48D are formed by portions of the flat portion 48C projecting outward from the outer peripheral surface of the tubular portion 48A. An upper surface of the flat portion 48C is a flat surface, and a sheet-shaped sealing material 78 is arranged. Specifically, the sealing material 78 is adhered to the flat surface. In the present exemplary embodiment, for example, the receiving port 49 is open in the flat surface of the flat portion 48C.

Supply Port

As shown in FIGS. 3 and 4, the supply port 55 is an opening portion provided on a downstream side of the replenishing path 54 of the replenishing device 50 in a transport direction of the developer G and is a portion that replenishes the developing device 40 with the developer G via the receiving port 49. The holder 60 is attached to the supply port 55.

Holder

As shown in FIGS. 3 and 4, the holder 60 is provided in the vicinity of the supply port 55 of the replenishing device 50 and has a function of connecting the developing device 40 and the replenishing device 50 to each other in a state where the developer G is suppliable from the supply port 55 to the receiving port 49 in a case where a portion in the vicinity of the receiving port 49 of the developing device 40 is inserted. Specifically, the holder 60 includes a recess portion 61 into which the supply port 55 is inserted, a guide portion 62 that guides insertion of the portion in the vicinity of the receiving port 49 of the developing device 40, and a supply port shutter 64 that opens and closes a communication port 63 which communicates with (passes through) the supply port 55.

As shown in FIGS. 3 and 4, the recess portion 61 is a portion of the holder 60 into which the supply port 55 is inserted. The communication port 63 is formed in a bottom portion of the recess portion 61. In addition, an annular seal member (not shown) may be arranged at the bottom portion of the recess portion 61 to surround the communication port 63. In a case of providing the seal member as described above, a tip of the supply port 55 inserted in the recess portion 61 is in contact with the seal member, and the developer G can be prevented from leaking from a portion between the replenishing path 54 and the holder 60. In addition, an opening 60C to which a hooking claw 56 provided on an outer periphery of the supply port 55 is hooked is provided in each of a front wall portion 60A and a rear wall portion 60B of the holder 60. By hooking the hooking claw 56 to the opening 60C, the supply port 55 is maintained in a state of being inserted in the holder 60.

As shown in FIG. 9, the guide portions 62 are provided on both sides of a lower surface 60D of the holder 60 with the communication port 63 sandwiched therebetween. Specifically, the guide portions are provided on both right and left sides with the communication port 63 sandwiched therebetween. The guide portions 62 are portions that guide the projecting portion 48D of the rear cover 48. More specifically, the guide portion 62 includes a wall portion 62A that extends downward from the lower surface 60D and a support portion 62B that projects inward (inward of the supply port 55 in a radial direction) from a lower end portion of the wall portion 62A and supports the projecting portion 48D of the rear cover 48. Herein, the projecting portion 48D is guided by the guide portion 62 by inserting the projecting portion 48D into a space between the lower surface 60D of the holder 60 and the support portion 62B.

Figure 6:
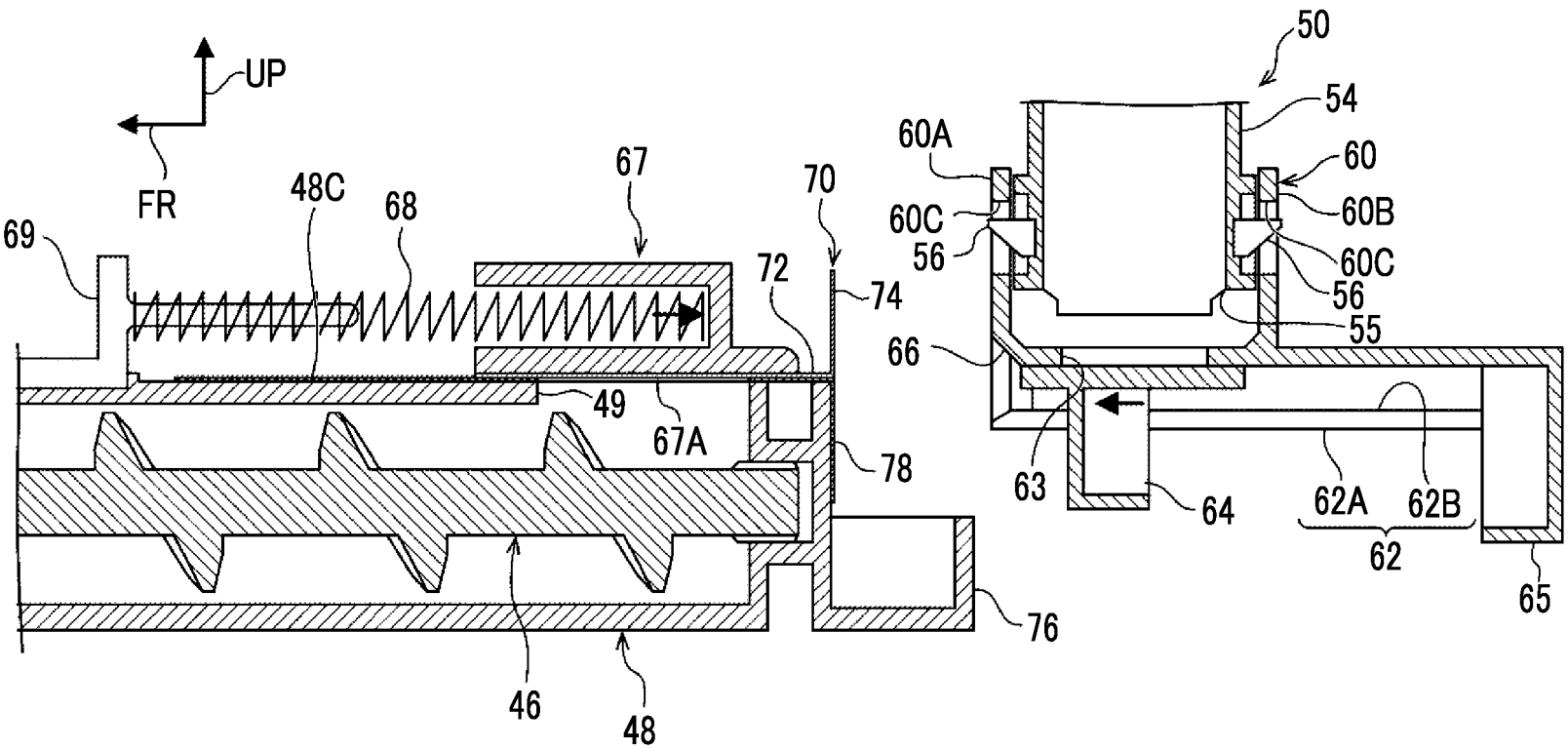
FIG. 6 is a cross-sectional view (cross-sectional view corresponding to FIG. 3) showing a state where the developing machine is removed from the replenisher.

As shown in FIGS. 3 and 6, the supply port shutter 64 is a member that slides along the lower surface 60D of the holder 60 and opens and closes the communication port 63. Specifically, the supply port shutter 64 slides on a portion between the guide portions 62 on both sides of the lower surface 60D of the holder 60 in the front-rear direction. The supply port shutter 64 is biased forward by a coil spring (not shown) provided at a support portion 65 on a rear side of the holder 60. In addition, the supply port shutter 64 is maintained in a state of closing the communication port 63 as being pressed by a stopper (not shown) provided at the holder 60.

Leading Surface

As shown in FIGS. 3 and 4, the leading surface 66 is a portion that leads the portion in the vicinity of the receiving port 49 of the developing device 40 to the holder 60. Specifically, the leading surface 66 is an inclined surface provided at a corner portion between a surface (that is, a front surface of the holder 60) of the front wall portion 60A and the lower surface 60D of the holder 60. As the holder 60 includes the leading surface 66 that leads the projecting portion 48D of the rear cover 48 to the space between the lower surface 60D of the holder 60 and the support portion 62B of the guide portion 62. That is, in a case of connecting the developing device 40 to the replenishing device 50 (that is, in a case of pressing the developing device 40 rearward), the flat portion 48C of the rear cover 48 comes into contact with the leading surface 66 of the holder 60, the flat portion 48C is lead to the leading surface 66, and the projecting portion 48D is guided to the space between the lower surface 60D and the support portion 62B.

Shutter

As shown in FIGS. 3 and 4, the receiving port shutter 67 is a member that opens and closes the receiving port 49 by moving in an insertion direction of the developing device 40. The receiving port shutter 67 is provided at the rear cover 48 to be slidable. Specifically, the receiving port shutter 67 slides on the flat portion 48C of the rear cover 48 in the front-rear direction. The receiving port shutter 67 is biased rearward by a coil spring 68 provided in front of the flat portion 48C of the rear cover 48. The coil spring 68 is supported by a support portion 69. In addition, the receiving port shutter 67 is maintained in a state of closing the receiving port 49 as being pressed by a stopper (not shown) provided at the rear cover 48. In addition, in a state where the developing device 40 is connected to the replenishing device 50 via the holder 60, as shown in FIG. 3, the receiving port shutter 67 is in contact with a front surface of the wall portion 62A of the holder 60 by means of a biasing force of the coil spring 68.

Seal Member

As shown in FIGS. 3 and 4, the seal member 70 is a member that is provided at the receiving port shutter 67 and comes into contact with the leading surface 66 in an elastically deformed state in a case where the developing device 40 and the replenishing device 50 are connected to each other. The seal member 70 has a function of preventing the developer G from leaking from a space between the receiving port 49 and the communication port 63 by coming into contact with the leading surface 66. The seal member 70 has a plate-shaped attachment portion 72 attached to a surface (lower surface 67A) of the receiving port shutter 67 on a developing device 40 side and a plate-shaped contact portion 74 that extends from a tip (rear end) of the attachment portion 72 to an opposite side to the developing device 40 and comes into contact with the leading surface 66. As shown in FIG. 4, the contact portion 74 is in surface-contact with the leading surface 66. Although almost the entire surface of the contact portion 74 is in surface-contact with the leading surface 66 in FIG. 4, the present disclosure is not limited thereto. For example, at least a part of the contact portion 74 may be in surface-contact with the leading surface 66.

In addition, as shown in FIG. 4, the tip (rear end) of the attachment portion 72 protrudes from a tip (rear end) of the receiving port shutter 67.

As shown in FIG. 4, the seal member 70 is configured by a material that is elastically deformable. Examples of a material for configuring the seal member 70 include a resin material and an elastic body (for example, a rubber material) that have flexibility. In the present exemplary embodiment, for example, the seal member 70 is formed of a PET material.

Figure 7:
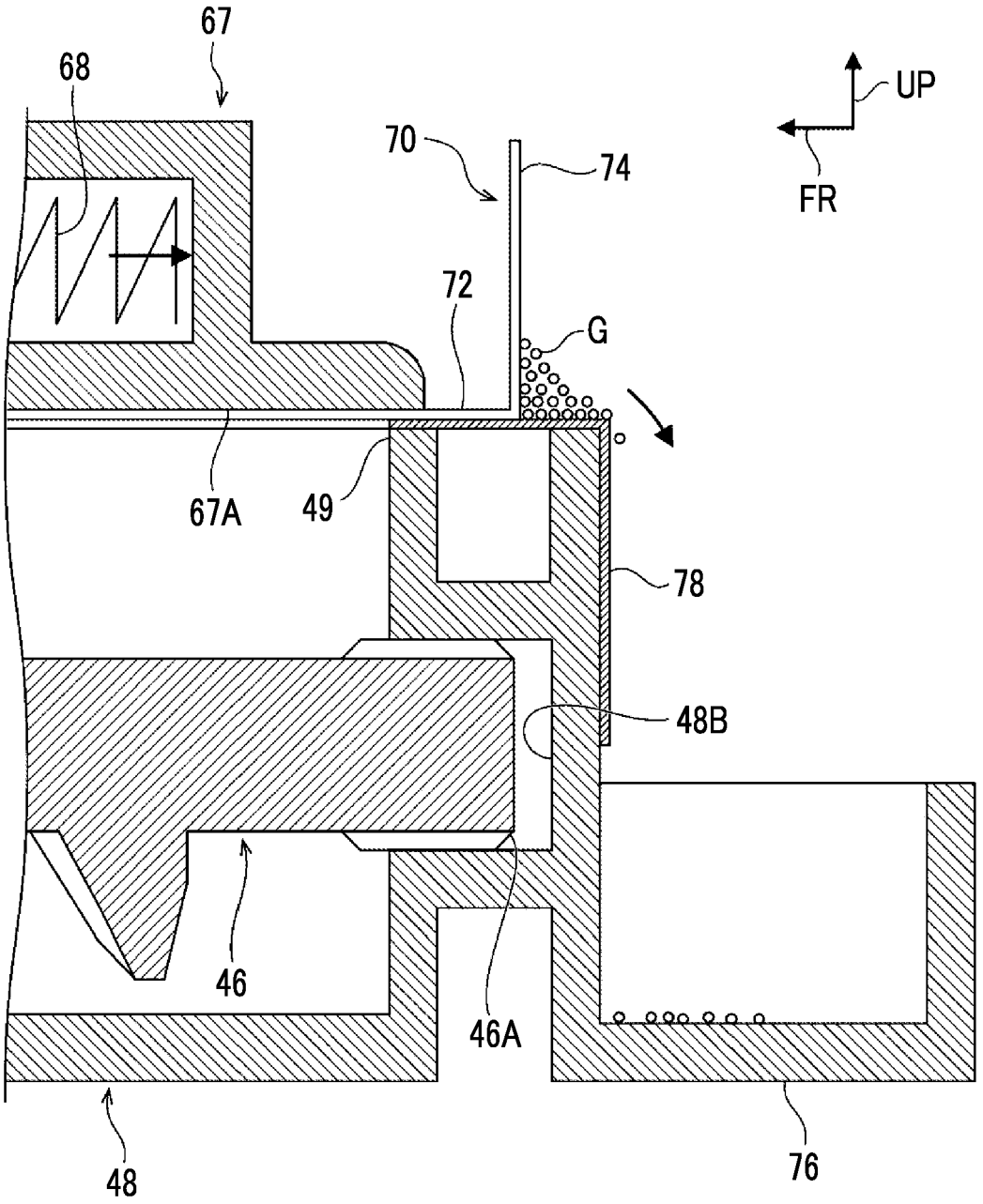
FIG. 7 is a cross-sectional view showing an operation of sending a developer leaking from a receiving port of the developing machine to a catcher with a contact member, with an operation of closing the receiving port by an opening and closing member.
Figure 8:
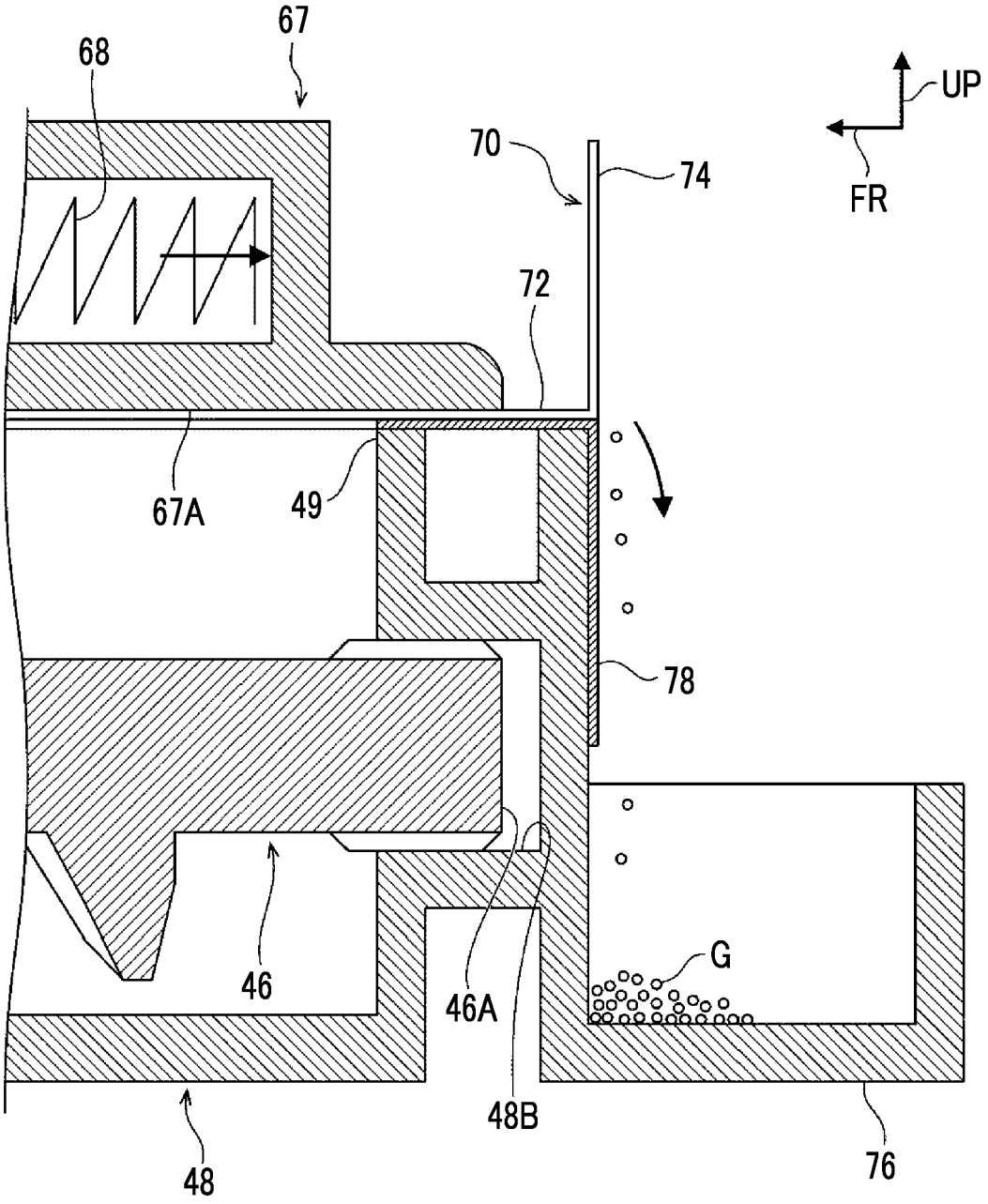
FIG. 8 is a cross-sectional view (cross-sectional view corresponding to FIG. 7) showing a state where the opening and closing member closes the receiving port.

In addition, as shown in FIGS. 7 and 8, the contact portion 74 of the seal member 70 of the present exemplary embodiment extends in a direction intersecting a moving direction of the receiving port shutter 67. Specifically, the contact portion 74 extends in a direction orthogonal to the moving direction of the receiving port shutter 67. That is, the seal member 70 has a shape in which the contact portion 74 is bent at a right angle with respect to the attachment portion 72 in side view, that is, a so-called L-shape.

In a state where the developing device 40 is connected to the replenishing device 50 via the holder 60, the seal member 70 of the present exemplary embodiment is a member that is bent along the leading surface 66 in a contact state with the leading surface 66. Specifically, the contact portion 74 of the seal member 70 is bent along the leading surface 66 (see FIG. 4).

In addition, as shown in FIGS. 3 and 7, a receiving portion 76 that receives the developer G is provided at a rear end portion of the rear cover 48. The receiving portion 76 is a portion that receives the developer G collected by the seal member 70 moving together with the receiving port shutter 67. Specifically, the developer G adhered in the vicinity of the receiving port 49 is collected by the seal member 70 moving together with the receiving port shutter 67 and is sent rearward. As shown in FIG. 8, in a case where the tip (rear end) of the attachment portion 72 of the seal member 70 reaches a rear end of the flat portion 48C of the rear cover 48, the developer falls and is received by the receiving portion 76.

Next, action of the exemplary embodiment of the present disclosure will be described.

In the present exemplary embodiment, in a case where the developing device 40 is connected to the holder 60 of the replenishing device 50, the seal member 70 provided at the receiving port shutter 67 comes into contact with the leading surface 66 in an elastically deformed state, as shown in FIG. 4. In other words, the seal member 70 is bent along the leading surface 66 in a contact state with the leading surface 66. For this reason, in the present exemplary embodiment, even in a case where there are variations in the size of a gap between the leading surface 66 and the flat surface of the flat portion 48C, the seal member 70 comes into contact with the leading surface 66 in an elastically deformed state. Thus, leakage of the developer G from a space between the developing device 40 and the holder 60 of the replenishing device 50 may be suppressed compared to a configuration where a part of the receiving port shutter 67 of the developing device 40 is brought into contact with the leading surface 66.

In addition, in the present exemplary embodiment, the seal member 70 is in surface-contact with the leading surface 66 as shown in FIG. 4. For this reason, in the present exemplary embodiment, leakage of the developer G may be suppressed compared to a configuration where the seal member 70 is in line-contact with the leading surface 66.

In addition, in the present exemplary embodiment, since the seal member 70 includes the plate-shaped attachment portion 72 and the plate-shaped contact portion 74, leakage of the developer G may be suppressed compared to a configuration where the tip of the plate-shaped attachment portion 72 is brought into contact with the leading surface 66.

In addition, in the present exemplary embodiment, the tip of the attachment portion 72 of the seal member 70 protrudes from the tip of the receiving port shutter 67. For this reason, in the present exemplary embodiment, as shown in FIG. 4, an effect of closing the gap between the leading surface 66 and the flat surface of the flat portion 48C is high, and leakage of the developer G may be suppressed compared to a configuration where the tip of the attachment portion 72 is at the same position as the position of the tip of the receiving port shutter 67.

In addition, in the present exemplary embodiment, the receiving port shutter 67 is biased against the coil spring 68 and is in contact with the holder 60. For this reason, in the present exemplary embodiment, the seal member 70 may be reliably brought into contact with the leading surface 66 compared to a configuration where the receiving port shutter 67 is separated from the holder 60.

Figure 5:
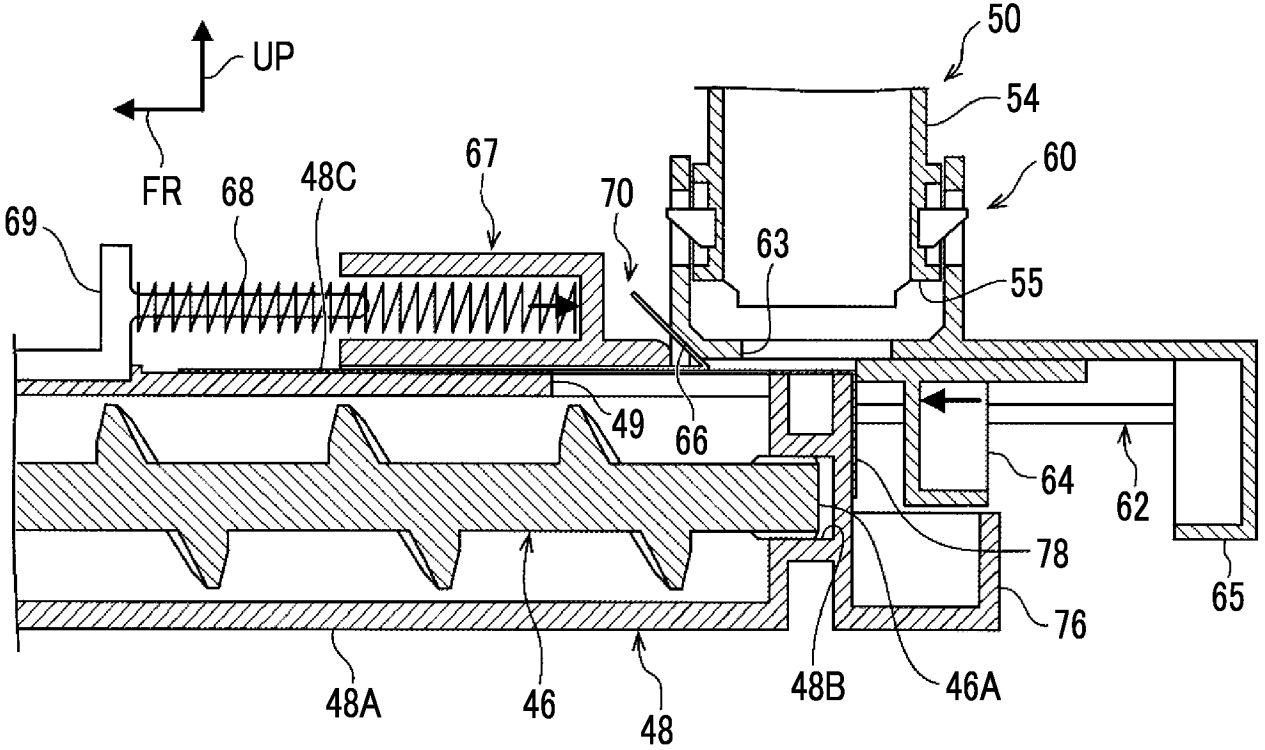
FIG. 5 is a cross-sectional view (cross-sectional view corresponding to FIG. 3) showing a state where the developing machine is being removed from the replenisher.

In addition, in the present exemplary embodiment, the rear cover 48 is provided at the receiving portion 76 that receives the developer G. As shown in FIG. 5, in a case where the developing device 40 is moved in a direction of being pulled out from the holder 60 of the replenishing device 50 (in a case of moving the developing device 40 to the front of the apparatus), the receiving port shutter 67 closes the receiving port 49, and the supply port shutter 64 closes the supply port 55 (see FIG. 6). As shown in FIGS. 7 and 8, in a case where the receiving port shutter 67 moves rearward and closes the receiving port 49, the developer G in the vicinity of the receiving port 49 is collected by the seal member 70 moving together with the receiving port shutter 67, falls from a rear end of the rear cover 48, and is received by the receiving portion 76. Herein, in a case where the tip of the attachment portion 72 of the seal member 70 is at the same position of the rear end of the rear cover 48 and protrudes in a state where the receiving port shutter 67 closes the receiving port 49, the developer G on the flat surface of the flat portion 48C may be sent to the receiving portion 76, for example, compared to a case where the tip of the attachment portion 72 does not reach the rear end of the rear cover 48 (in a case of being on the front).

In addition, in the present exemplary embodiment, the contact portion 74 of the seal member 70 extends in the direction intersecting (a direction orthogonal to, in the present exemplary embodiment) the moving direction of the receiving port shutter 67. For this reason, the developer G adhered in the vicinity of the receiving port 49 may be sent to the receiving portion 76 compared to a case where the contact portion 74 is inclined to an opposite side to the insertion direction of the developing device 40. In particular, as the contact portion 74 of the seal member 70 extends in a direction orthogonal to the attachment portion 72, the developer G may be effectively sent to the receiving portion 76.

In addition, in the present exemplary embodiment, since the image forming apparatus 10 includes the connection structure S, leakage of the developer G from the space between the developing device 40 and the replenishing device 50 is suppressed. For this reason, in the present exemplary embodiment, contamination caused by the developer G in the image forming apparatus 10 may be suppressed compared to a configuration of not including the connection structure S. In particular, since the developer G is received by the receiving portion 76, the contamination caused by the developer G in the image forming apparatus 10 is effectively suppressed compared to a configuration of not including the receiving portion 76.

Other Exemplary Embodiments

Figure 10:
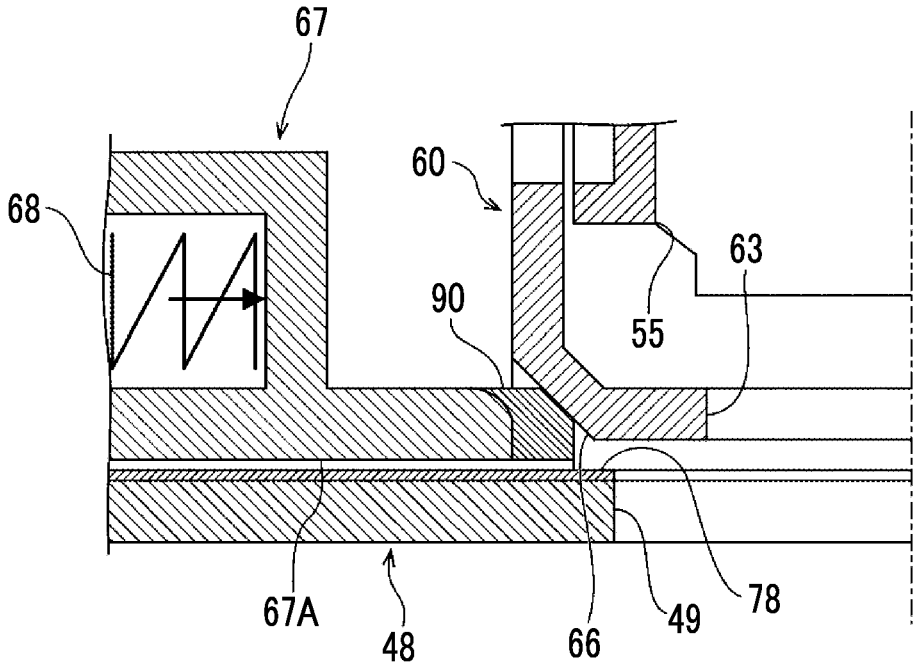
FIG. 10 is an enlarged cross-sectional view (cross-sectional view corresponding to FIG. 4) of a developing machine of an image forming apparatus according to another exemplary embodiment of the present disclosure and a vicinity of a connecting portion of a replenisher.

Although the seal member 70 formed of a resin material is brought into contact with the leading surface 66 to suppress leakage of the developer G in the exemplary embodiment described above, the present disclosure is not limited to this configuration. For example, as shown in FIG. 10, an elastically deformable elastic body (for example, a rubber material) 90 may be used as the contact member. Also in this case, the same action as the seal member 70 can be obtained.

In addition, although the seal member 70 is in surface-contact with the leading surface 66 in the exemplary embodiment described above, the present disclosure is not limited to this configuration, and the seal member 70 may be configured to be in line-contact with the leading surface 66. Also in this case, leakage of the developer G from the space between the developing device 40 and the holder 60 of the replenishing device 50 may be suppressed.

In addition, although the seal member 70 includes the plate-shaped attachment portion 72 and the plate-shaped contact portion 74 in the exemplary embodiment described above, the present disclosure is not limited to this configuration. For example, a block-shaped seal member may be provided at the tip of the receiving port shutter 67.

In addition, although the tip (rear end) of the attachment portion 72 protrudes from the tip (rear end) of the receiving port shutter 67 in the exemplary embodiment described above, the present disclosure is not limited to this configuration. Even in a case where the tip of the attachment portion 72 is at the same position as the tip of the receiving port shutter 67, the tip of the attachment portion may be on the front.

In addition, although the receiving port shutter 67 is biased against the coil spring 68 and is in contact with the holder 60 in the exemplary embodiment described above, the present disclosure is not limited to this configuration. For example, the receiving port shutter 67 may be in contact with the holder 60 via the seal member 70.

In addition, although the tip of the attachment portion 72 of the seal member 70 protrudes from or is at the same position as the rear end of the rear cover 48 in a state where the receiving port shutter 67 closes the receiving port 49 in the exemplary embodiment described above, the present disclosure is not limited to this configuration. For example, the tip of the attachment portion 72 of the seal member 70 may be in front of the rear end of the rear cover 48 in a state where the receiving port shutter 67 closes the receiving port 49.

In addition, although the contact portion 74 of the seal member 70 extends in the direction orthogonal to the attachment portion 72, in other words, has an L-shape in side view in the exemplary embodiment described above, the present disclosure is not limited to this configuration. The contact portion 74 of the seal member 70 may be inclined toward the apparatus front with respect to the attachment portion 72.

The present disclosure is not limited to the exemplary embodiment, and various modifications, changes, and improvements can be made without departing from the gist thereof. For example, the plurality of modification examples described above may be configured in combination as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A connection structure comprising:

a receiving port for a developer, that is provided in a developing machine;

a supply port for a developer, that is provided in a replenisher;

a connecting portion that is provided in a vicinity of the supply port of the replenisher and connects the developing machine and the replenisher to each other in a state where a developer is suppliable from the supply port to the receiving port in a case where a portion in a vicinity of the receiving port of the developing machine is inserted;

a leading surface that is provided at the connecting portion and leads the portion in the vicinity of the receiving port of the developing machine to the connecting portion;

an opening and closing member that opens and closes the receiving port by moving in an insertion direction of the developing machine; and a contact member that is provided at the opening and closing member and comes into contact with the leading surface in an elastically deformed state in a case where the developing machine and the replenisher are connected to each other.

2. The connection structure according to claim 1, wherein the contact member comes into surface-contact with the leading surface.

3. The connection structure according to claim 2, wherein the contact member has a plate-shaped attachment portion that is attached to a surface of the opening and closing member on a developing machine side and a plate-shaped contact portion that extends from a tip of the attachment portion to an opposite side to the developing machine and that comes into contact with the leading surface.

4. The connection structure according to claim 3, wherein the tip of the attachment portion protrudes from a tip of the opening and closing member.

5. The connection structure according to claim 2, wherein the opening and closing member is biased in the insertion direction and is in contact with the connecting portion.

6. The connection structure according to claim 1, wherein the contact member has a plate-shaped attachment portion that is attached to a surface of the opening and closing member on a developing machine side and a plate-shaped contact portion that extends from a tip of the attachment portion to an opposite side to the developing machine and that comes into contact with the leading surface.

7. The connection structure according to claim 6, wherein the tip of the attachment portion protrudes from a tip of the opening and closing member.

8. The connection structure according to claim 6, wherein the opening and closing member is biased in the insertion direction and is in contact with the connecting portion.

9. The connection structure according to claim 1, wherein the opening and closing member is biased in the insertion direction and is in contact with the connecting portion.

10. The connection structure according to claim 1, wherein the opening and closing member is biased in the insertion direction, a receiving portion that receives a developer is provided at an end portion of the developing machine on an insertion direction side, and the contact member protrudes from the end portion of the developing machine on the insertion direction side in a state where the opening and closing member closes the receiving port.

11. The connection structure according to claim 10, wherein the contact member has a plate-shaped attachment portion that is attached to a surface of the opening and closing member on a developing machine side and a plate-shaped contact portion that extends from a tip of the attachment portion to an opposite side to the developing machine and that comes into contact with the leading surface, and the contact portion extends in a direction intersecting a moving direction of the opening and closing member.

12. An image forming apparatus comprising:

an image holding body;

a developing machine that forms a developer image on the image holding body;

a replenisher that supplies a developer to the developing machine; and the connection structure according to claim 1, that connects the developing machine and the replenisher to each other.

13. A connection structure comprising:

a receiving port for a developer, that is provided in a developing machine;

a supply port for a developer, that is provided in a replenisher;

a connecting portion that is provided in a vicinity of the supply port of the replenisher and connects the developing machine and the replenisher to each other in a state where a developer is suppliable from the supply port to the receiving port in a case where a portion in a vicinity of the receiving port of the developing machine is inserted;

a leading surface that is provided at the connecting portion and leads the portion in the vicinity of the receiving port of the developing machine to the connecting portion;

an opening and closing member that opens and closes the receiving port by moving in an insertion direction of the developing machine; and a contact member that is provided at an end portion of the opening and closing member in the insertion direction and is bent along the leading surface in a contact state with the leading surface.

14. The connection structure according to claim 13, wherein the contact member comes into surface-contact with the leading surface.

15. The connection structure according to claim 14, wherein the contact member has a plate-shaped attachment portion that is attached to a surface of the opening and closing member on a developing machine side and a plate-shaped contact portion that extends from a tip of the attachment portion to an opposite side to the developing machine and that comes into contact with the leading surface.

16. The connection structure according to claim 15, wherein the tip of the attachment portion protrudes from a tip of the opening and closing member.

17. The connection structure according to claim 14, wherein the opening and closing member is biased in the insertion direction and is in contact with the connecting portion.

18. The connection structure according to claim 13, wherein the contact member has a plate-shaped attachment portion that is attached to a surface of the opening and closing member on a developing machine side and a plate-shaped contact portion that extends from a tip of the attachment portion to an opposite side to the developing machine and that comes into contact with the leading surface.

19. The connection structure according to claim 18, wherein the tip of the attachment portion protrudes from a tip of the opening and closing member.

20. The connection structure according to claim 13, wherein the opening and closing member is biased in the insertion direction and is in contact with the connecting portion.

* * * * *